US007294973B2

(12) United States Patent
Takahama et al.

(10) Patent No.: US 7,294,973 B2
(45) Date of Patent: Nov. 13, 2007

(54) DISCHARGE TUBE LIGHTING APPARATUS, LIGHT SOURCE APPARATUS, AND DISPLAY APPARATUS

(75) Inventors: Masanobu Takahama, Saitama (JP); Yoshiki Oyama, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 11/430,337

(22) Filed: May 9, 2006

(65) Prior Publication Data

US 2006/0279232 A1 Dec. 14, 2006

(30) Foreign Application Priority Data

May 10, 2005 (JP) ..... P2005-137055
Mar. 23, 2006 (JP) ..... P2006-081287

(51) Int. Cl.
*H05B 37/02* (2006.01)

(52) U.S. Cl. ..... 315/224; 315/291; 315/278; 315/312; 315/DIG. 7; 315/209 R; 361/36; 361/38

(58) Field of Classification Search ..... 315/209 R, 315/291, 307, 219, 247, 224, 278, 282, 82, 315/312, DIG. 5, DIG. 7; 361/35–38, 268, 361/270; 345/84, 87; 349/65, 70; 363/23–26, 363/56.05, 62, 64

See application file for complete search history.

(56) References Cited

U.S. PATENT DOCUMENTS 5,751,120 A 5/1998 Zeitler et al.
6,636,190 B2 * 10/2003 Hirakata et al. ..... 345/74.1
7,025,488 B2 * 4/2006 Akiho ..... 362/613
7,141,933 B2 * 11/2006 Ball ..... 315/57
2006/0158124 A1 * 7/2006 Hosaka et al. ..... 315/82

FOREIGN PATENT DOCUMENTS

| | | | |
|---|---|---|---|
| EP | 1 043 918 | A | 10/2000 |
| EP | 1 517 591 | A | 3/2005 |
| JP | 56-86495 | A | 7/1981 |
| JP | 07-245186 | A | 9/1995 |
| JP | 11-003792 | A | 1/1999 |
| JP | 2004-335443 | A | 11/2004 |

OTHER PUBLICATIONS

European Search Report, EP 06 25 2347, Dated Aug. 22, 2006.

* cited by examiner

*Primary Examiner*—Haissa Philogene
(74) *Attorney, Agent, or Firm*—Lerner, David, Littenberg, Krumholz & Mentlik, LLP

(57) ABSTRACT

A discharge tube lighting apparatus is used to drive a plurality of discharge tubes. The apparatus includes a balance coil having a winding input end and a plurality of winding output ends to which the discharge tubes are connected individually; a power section for supplying ac current to the winding input end of the balance coil; and a control section for detecting a peak value of detection voltages corresponding to voltages at the winding output ends of the balance coil and for stopping the supply of the ac current from the power section when the peak value of the detection voltages is higher than a predetermined value.

9 Claims, 9 Drawing Sheets

DISCHARGE TUBE LIGHTING APPARATUS, LIGHT SOURCE APPARATUS, AND DISPLAY APPARATUS

CROSS-REFERENCE TO RELATED APPLICATIONS

The present application claims priority from Japanese Patent Application Nos. JP 2005-137055 filed May 10, 2005 and JP 2006-081287 filed on Mar. 23, 2006, the disclosures of which are hereby incorporated by reference herein.

BACKGROUND OF THE INVENTION

This invention relates to a discharge tube lighting apparatus, a light source apparatus, and a display apparatus, and more particularly to a discharge tube lighting apparatus which includes a balance coil for driving a large number of discharge tubes to emit light using a smaller number of inverter circuits and a light source apparatus and a display apparatus which use a discharge tube lighting apparatus.

In recent years, image display apparatus which make use of liquid crystal are used popularly. A display apparatus of the type described requires a light source apparatus for irradiating light from the rear side of a liquid crystal panel, and such a light source apparatus as just mentioned is usually called backlight. Together with increase in scale of a display apparatus, increase in scale also of the backlight which composes the display apparatus has proceeded, and a discharge tube is used for the backlight. However, it is not efficient to drive a plurality of discharge tubes individually by means of driving circuits provided individually for the discharge tubes. Thus, a discharge tube lighting apparatus which uses one inverter circuit to drive a plurality of discharge tubes to emit light is used. A light source apparatus that a discharge tube section including a plurality of discharge tubes is driven by such a discharge tube lighting apparatus as described above is used. Further, in a backlight of an increased scale, a plurality of inverters are used, and a backlight is formed from a number of discharge tubes greater than the number of inverters.

Where a plurality of discharge lamps are driven to emit light by a single inverter circuit in this manner, there is a problem that electric current of different magnitudes flows through the discharge tubes. To solve this problem, an apparatus which includes a balance coil has been proposed and is disclosed, for example, in Japanese Patent Laid-open No. Sho 56-86495.

Where a balance coil is used, if one of discharge tubes does not discharge, then an excessively high voltage is generated across windings of the balance coil and damages the windings of the balance coil. Therefore, a countermeasure which includes a diac disposed in parallel to each winding to protect the winding is reported. Also a system which detects an anomaly of a discharge apparatus from current flowing through a photo-coupler when a voltage generated in any one of windings exceeds a breakdown voltage of a Zener diode has been proposed and is disclosed in Japanese Patent Laid-open No. 2004-335443.

An example of a balance coil is disclosed in Japanese Patent Laid-open No. 2005-317253 and shown in FIGS. 11A and 11B. FIG. 11B shows a schematic view of the balance coil 30 in an assembled state, and FIG. 11A shows, in plan, a bobbin which composes the balance coil 30. Referring to FIGS. 11A and 11B, the bobbin 20 is shaped such that a winding frame thereof is divided into two winding regions by a main partition 22 at an intermediate portion thereof and an auxiliary partition 24 is provided in each of the winding regions so that the winding region is divided into a plurality of (two in the arrangement shown) sections. The two windings are wound separately from each other in the different winding regions on a single bobbin having the main partition 22 formed at an intermediate portion thereof, and each of the windings is wound divisionally in the two sections divided by the auxiliary partition 24. The bobbin 20 is a unitary molded article made of an electric insulating material. Thus, the two windings are provided separately from each other. A magnetic core 28 is combined with the bobbin which has terminals 26 to assemble the balance coil 30. While, in the arrangement shown in FIGS. 11A and 11B, one auxiliary partition is provided in each of the winding regions so that the balance coil 30 has a two-section structure. However, two auxiliary partitions may be provided in each of the winding regions so that the balance coil 30 may have a three-section structure. Naturally, each winding region may be divided into a greater number of sections. However, the number of sections is determined taking the number of windings, the winding wire diameter, and so forth into consideration. The magnetic core is structured such that two E type cores made of a high-permeability magnetic material such as a NiZn type ferrite material or a MnZn type ferrite material are assembled such that the leg portions thereof are disposed in an opposing relationship with each other with ends thereof held in contact with each other.

As described hereinabove, where a balance coil is used, the subject of the current balance of discharge tubes is solved. However, if a line connecting from the balance coil to one of the discharge tubes is not connected by breaking of a wiring line pattern, failure in connection of a connector, or the like, then it is supposed that a high voltage is generated in the wiring line of the balance coil which corresponds to the disconnected line. In such an instance, there is the possibility that a discharge phenomenon may occur between wiring patterns, between the windings of the balance coil, or between the wiring and the core which form a magnetic circuit, whereupon a stench is given off, the balance coil may burn out, or a printed circuit board may be carbonized.

Where the countermeasure described above against such a subject as just described that a diac is disposed in parallel to each of windings is adopted, a high cost is required for the countermeasure and merely the subject of protection of windings for a predetermined period of time can be solved. However, application of a voltage to the diac continues for a long period of time, there is the possibility that the diac may be damaged, resulting in loss of the protection of the same. Further, a detection circuit which uses a photo-coupler can merely detect an abnormal voltage across a winding of a balance coil, but no measures after detection of an abnormal voltage is taken.

It is desirable to provide a discharge tube lighting apparatus, a light source apparatus, and a display apparatus to surely solve the above-mentioned problems by low cost.

SUMMARY OF THE INVENTION

According to an embodiment of the present invention, a discharge tube lighting apparatus for driving a plurality of discharge tubes includes a balance coil having a winding input end and a plurality of winding output ends to which the discharge tubes are connected individually; a power section for supplying ac current to the winding input end of the balance coil; and a control section for detecting a peak value of detection voltages corresponding to voltages at the winding output ends of the balance coil and for stopping the supply of the ac current from the power section when the peak value of the detection voltages is higher than a predetermined value.

The discharge tube lighting apparatus includes a balance coil having a winding input end and a plurality of winding output ends and a power section for supplying ac current to the winding input end of the balance coil, and causes uniform current to flow through the discharge tubes by an action of the balance coil.

The discharge tube lighting apparatus further includes a control section for detecting a peak value of detection voltages corresponding to voltages at the winding output ends of the balance coil and for stopping the supply of the ac current from the power section when the peak value of the detection voltages is higher than a predetermined value, and prevents otherwise possible damage to a circuit board and to the balance coil.

The balance coil is also called a balance transformer or common mode choke coil, and includes a plurality of windings connected to each other such that an input end and a plurality of output ends are provided, and has a magnetic circuit formed in such a manner that magnetic fluxes produced by each of the windings cross with all or some of the other windings so that the magnetic fluxes cancel each other to allow electric current of a predetermined value to flow to each of the output ends.

According to a second embodiment of the present invention, a light source apparatus includes a balance coil having a winding input end and a plurality of winding output ends; a discharge tube section including a plurality of discharge tubes individually connected to the winding output ends of the balance coil; a power section for supplying ac current to the winding input end of the balance coil; and a control section for detecting a peak value of detection voltages corresponding to voltages at the winding output ends of the balance coil and for stopping the supply of the ac current from the power section when the peak value of the detection voltages is higher than a predetermined value.

The light source apparatus includes a balance coil having a winding input end and a plurality of winding output ends; a discharge tube section including a plurality of discharge tubes individually connected to the winding output ends of the balance coil; and a power section for supplying ac current to the winding input end of the balance coil, and causes uniform current to flow through the discharge tubes by an action of the balance coil.

The light source apparatus further includes a control section for detecting a peak value of detection voltages corresponding to voltages at the winding output ends of the balance coil and for stopping the supply of the ac current from the power section when the peak value of the detection voltages is higher than a predetermined value, and prevents otherwise possible damage to a circuit board and to the balance coil.

According to a further embodiment of the present invention, a display apparatus includes a liquid crystal display panel having an image display face for displaying image information; a discharge tube section disposed on a rear face of the liquid crystal display panel opposite the image display face; and a discharge tube lighting apparatus for driving the discharge tube section. The discharge tube lighting apparatus includes a balance coil having a winding input end and a plurality of winding output ends to which the discharge tubes are connected individually; a power section for supplying ac current to the winding input end of the balance coil; and a control section for detecting a peak value of detection voltages corresponding to voltages at the winding output ends of the balance coil and for stopping the supply of the ac current from the power section when the peak value of the detection voltages is higher than a predetermined value.

The display apparatus includes a liquid crystal display panel having an image display face for displaying image information; a discharge tube section disposed on a rear face of the liquid crystal display panel opposite the image display face; and a discharge tube lighting apparatus for driving the discharge tube section. The discharge tube lighting apparatus includes a balance coil having a winding input end and a plurality of winding output ends; and a power section for supplying ac current to the winding input end of the balance coil, and causes uniform current to flow through the discharge tubes by an action of the balance coil. The display apparatus further includes a control section for detecting a peak value of detection voltages corresponding to voltages at the winding output ends of the balance coil and for stopping the supply of the ac current from the power section when the peak value of the detection voltages is higher than a predetermined value, and prevents otherwise possible damage to a circuit board and to the balance coil.

With the discharge tube lighting apparatus, light source apparatus, and display apparatus, the problems which may possibly be estimated to occur where a balance coil is used can be prevented. For example, the problems may be burning of the balance coil or carbonization of a circuit board by heat generation from the circuit board.

DETAILED DESCRIPTION

Figure 1:
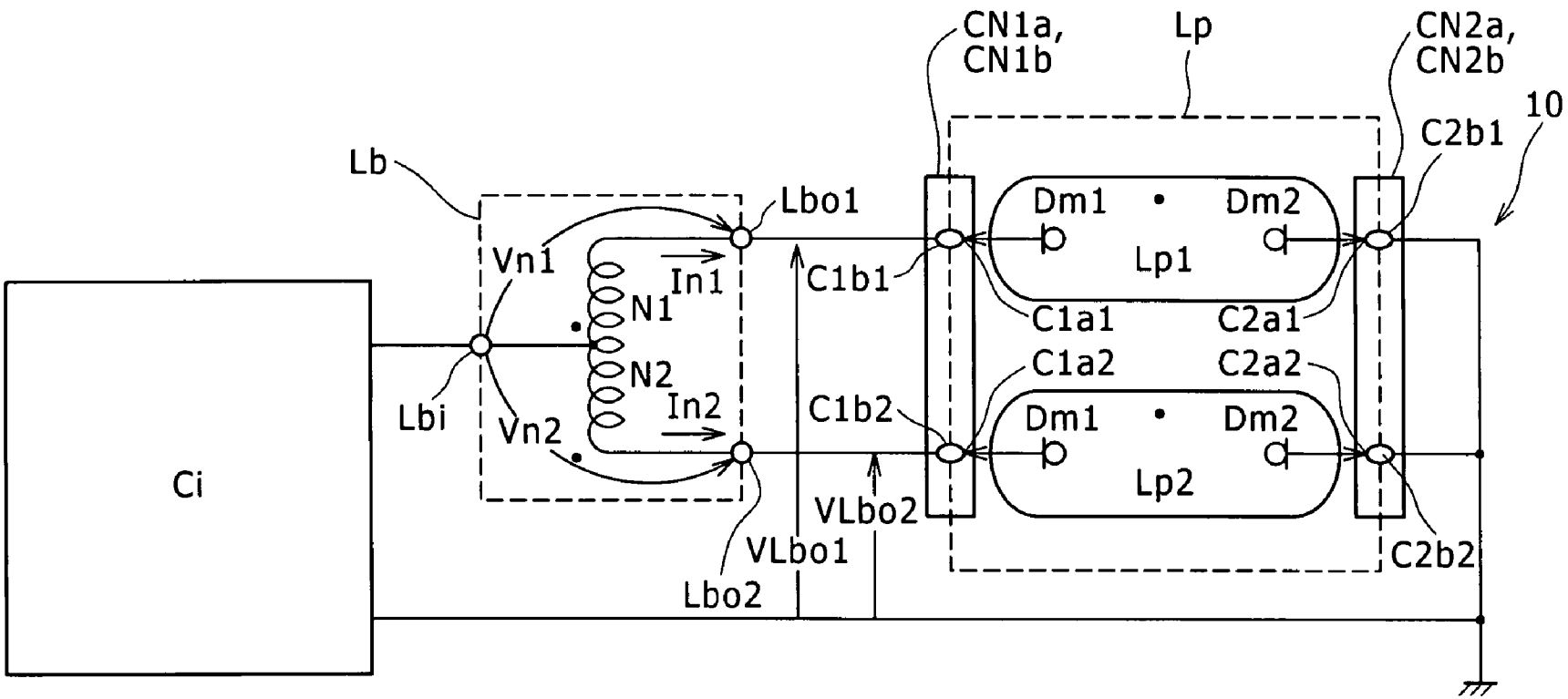
FIG. 1 is a circuit diagram illustrating a principle of operation of a balance coil of a light source apparatus according to an embodiment of the present invention.
Figure 2:
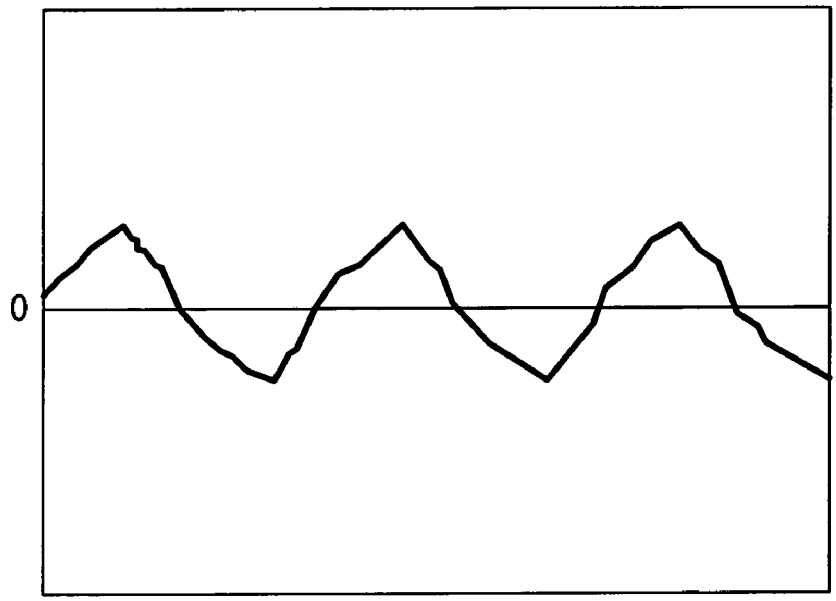
FIG. 2 is a diagram illustrating a waveform generated in the balance coil of the light source apparatus of FIG. 1 when each of current which magnitude is equal to each other flows through a plurality of discharge tubes of the light source apparatus.
Figure 3:
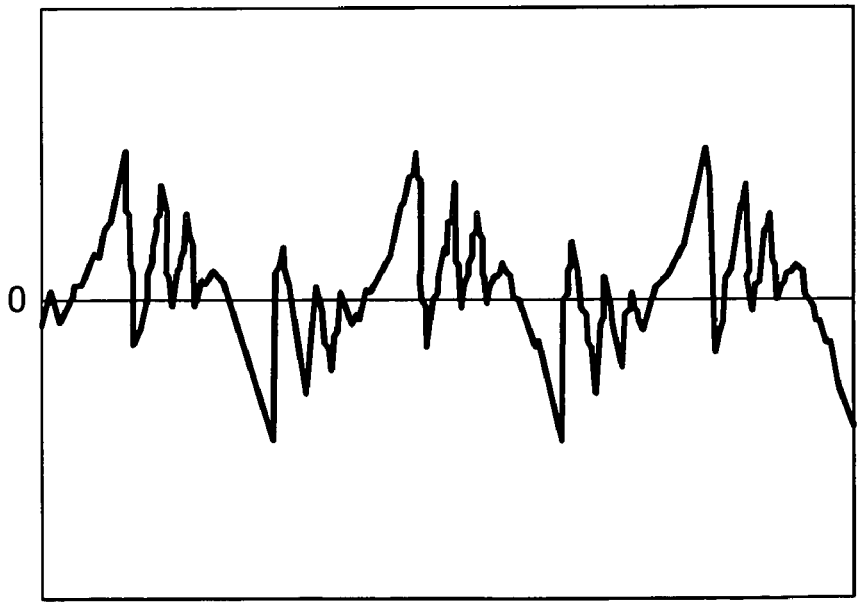
FIG. 3 is a diagram illustrating a waveform generated in the balance coil of the light source apparatus of FIG. 1 when current which magnitude is different from each other flows through the discharge tubes of the light source apparatus.

FIGS. 1 to 3 illustrate an example of operation of a balance coil Lb of a light source apparatus 10 to which an embodiment of the present invention is applied. Referring first to FIG. 1, the light source apparatus 10 shown includes a discharge tube lighting apparatus which includes an inverter circuit Ci, which is a form of a power section, and a balance coil Lb. A discharge tube section Lp is formed from a discharge tube Lp1 and another discharge tube Lp2. Each of the discharge tubes Lp1 and Lp2 has a conductive electrode Dm1 and another conductive electrode Dm2. Each of the conductive electrodes Dm1 is connected to a connector CN1*a* through a wiring line, and each of the conductive electrodes Dm2 is connected to another connector CN2*a* through a wiring line. Meanwhile, a connector CN1*b* which is used in combination with the connector CN1*a* is connected to winding output ends Lbo1 and Lbo2 of the balance coil Lb, and another connector CN2*b* which is used in combination with the connector CN2*a* is connected to the inverter circuit Ci. In particular, each of the connectors CN1*a* and CN2*a* has contacts C1*a*1 and C1*a*2 and contacts C2*a*1 and C2*a*2 which serve as male side contacts each formed from a bar-like conductor, respectively. Each of the contacts CN1*b* and CN2*b* has contacts C1*b*1 and C1*b*2 and contacts C2*b*1 and C2*b*2 which are female side contacts each formed from a conductor which presses against the male side with a spring pressure, respectively.

Here, the contacts C1*a*1 and C1*b*1, contacts C1*a*2 and C1*b*2, contacts C2*a*1 and C2*b*1, and contacts C2*a*2 and C2*b*2 contact with each other to form a circuit. Thus, the discharge tube section Lp can be removed from the light source apparatus 10. It is to be noted that the structure of the connectors CN1*a*, CN1*b*, CN2*a*, and CN2*b* and the structure of the contacts are not limited to those described above, but any structure may be used only if the discharge tube section Lp can be removably connected to the inverter circuit Ci and the balance coil Lb. Also there is no restriction to arrangement of the discharge tube section Lp on the male side or the female side of the contacts, and the structure of the contacts may be any structure which presses against the contacts connected to both circuits. Where the circuit board on which the inverter circuit Ci and the balance coil Lb are disposed and the discharge tube section Lp is removably mounted in this manner, assembly and maintenance of the apparatus can be performed readily.

The inverter circuit Ci supplies ac power of several tens kHz. Further, a winding N1 and another winding N2 are wound on the same core of the balance coil Lb and commonly have a magnetic circuit. The windings N1 and N2 are connected on one end side thereof to each other and form a winding input end Lbi of the balance coil Lb, and the other end side of the windings N1 and N2 forms the winding output ends Lbo1 and Lbo2, respectively. Here, a black round mark applied to the balance coil Lb indicates a winding beginning end. Meanwhile, each of the discharge tubes Lp1 and Lp2 is formed as a cylindrical glass tube having a conductive electrode Dm1 and a conductive electrode Dm2 disposed at the opposite ends thereof and having gas enclosed therein.

The inverter circuit Ci is connected to the winding input end Lbi of the balance coil Lb. The conductive electrode Dm1 of the discharge tube Lp1 is connected to the winding output end Lbo1 of the balance coil Lb through the connectors CN1*a* and CN1*b*, and the conductive electrode Dm1 of the discharge tube Lp2 is connected to the winding output end Lbo2 of the balance coil Lb through the connectors CN1*a* and CN1*b*. The conductive electrode Dm2 of the discharge tube Lp1 and the conductive electrode Dm2 of the discharge tube Lp2 are connected to each other and connected to the inverter circuit Ci through the connectors CN2*a* and CN2*b*. In the connection scheme described, ac current is supplied to the discharge tubes Lp1 and Lp2 such that the inverter circuit Ci cancels the magnetism generated by the balance coil Lb.

In particular, the windings N1 and N2 are connected on one end side thereof to each other and define the winding input end Lbi. Therefore, current inputted from the winding input end Lbi is shunted to the windings N1 and N2 and flows out from the winding output ends Lbo1 and Lbo2. At this time, the directions of magnetic fluxes generated by the winding N1 and magnetic fluxes generated by the winding N2 are opposite to each other. Consequently, if the numbers of turns of the windings N1 and N2 are equal to each other, then where the magnitude of electric current In1 flowing through the winding N1 and the magnitude of electric current In2 flowing through the winding N2 are equal to each other, the magnetic fluxes in the case cancel each other and therefore exhibit the magnitude of zero.

On the other hand, if the magnitude of the current In1 and the magnitude of the current In2 are not equal to each other, then magnetic fluxes are generated in the core, and a voltage Vn1 and another voltage Vn2 are generated across the windings N1 and N2, respectively, by the magnetic fluxes. The directions of the voltages generated at this time are opposite to each other. Then, if the magnitude of the current In1 is smaller than the magnitude of the current In2, then the magnitude of a voltage VLbo1 at the winding output end Lbo1 to which the voltage Vn1 is additionally added becomes greater than the magnitude of a voltage VLbo2 at the winding output end Lbo2 to which the voltage Vn2 is additionally applied.

On the contrary, if the magnitude of the current In1 is greater than the magnitude of the current In2, then the magnitude of the voltage VLbo1 at the winding output end Lbo1 becomes smaller than the magnitude of the voltage VLbo2 of the winding output end Lbo2. As a result, such a feedback action appears that the magnitude of the current In1 flowing through the winding N1, that is, the magnitude of the current flowing through the discharge tube Lp1, and the magnitude of the current In2 flowing through the winding N2, that is, the magnitude of the current flowing through the discharge tube Lp2, become substantially equal to each other.

Thus, even if the discharge tubes Lp1 and Lp2 have a dispersion in characteristic therebetween where the discharge tubes Lp1 and Lp2 are driven by the single inverter circuit Ci, the magnitude of the current flowing through the discharge tube Lp1 and the magnitude of the current flowing through the discharge tube Lp2 can be made equal to each other. As a result, the luminances of light emitted from the discharge tubes Lp1 and Lp2 can be uniformized.

FIG. 2 illustrates a waveform of the voltage VLbo1 at the winding output end Lbo1 where the magnitude of current flowing through the discharge tube Lp1 and the magnitude of current flowing though the discharge tube Lp2 are equal to each other, that is, where both of the magnitude of the voltage Vn1 generated in the winding N1 and the magnitude of the voltage Vn2 generated in the winding N2 are equal to zero (in this instance, also the waveform of the voltage VLbo2 of the winding output end Lbo2 is same as that of the voltage VLbo1 of the winding output end Lbo1). Here, the period of the voltage VLbo1 is equal to that of repetitions of the ac current outputted from the inverter.

FIG. 3 illustrates a waveform of the voltage VLbo1 at the winding output end Lbo1 where the magnitude of current flowing through the discharge tube Lp1 is zero. Here, the case that the magnitude of current flowing through the discharge tube Lp1 is zero corresponds to several cases. The examples of the cases are when the discharge tube Lp1 is not mounted or when a wiring line to the discharge tube Lp1 is not connected, for example, as a result of breaking of a wiring line pattern. Also the other examples are when the connectors CN1*a* and CN1*b* for connecting the winding output end Lbo1 and the conductive electrode Dm1 of the discharge tube Lp1 are not connected to each other (the contacts C1*a*1 and C1*b*1 are not in contact with each other) or when the connectors CN2*a* and CN2*b* for connecting the conductive electrode Dm2 of the discharge tube Lp1 and the inverter circuit Ci are not connected to each other (the contacts C2*a*1 and C2*b*1 are not in contact with each other). Similarly, a case that the magnitude of current flowing through the discharge tube Lp2 is zero corresponds to several cases. The examples the cases are when a wiring line pattern is in a disconnected state, when the connectors CN1*a* and CN1*b* for connecting the winding output end Lbo2 and conductive electrode DM1 of the discharge tube Lp2 are not connected (the contacts C1*a*2 and C1*b*2 are not in contact with each other), and when the connectors CN2*a* and CN2*b* for connecting the conductive electrode Dm2 of the discharge tube Lp2 and the inverter circuit Ci are not in a connected state (the contacts C2*a*2 and C2*b*2 are not in contact with each other).

As seen in FIG. 3, where the waveform of the voltage VLbo1 at the winding output end Lbo1 is compared with the waveform shown in FIG. 2, it has higher peak values and exhibits superposition of components of shorter periods than that of the inverter.

Here, it is one of reasons why the waveform has higher peak values that resonance components of periods shorter than the period of the inverter are superposed and coincide with peak values of the signal of the inverter period. However, a principal reason is that, because current flowing through the discharge tube Lp1, that is, the current In1 flowing through the winding N1, is zero, the magnitude of magnetic fluxes in the core of the balance coil Lb does not become zero and a voltage higher than that where the magnitude of magnetic fluxes in the core is zero is generated as a value of the voltage VLbo1 in the discharge tube Lp1.

Figure 11A:
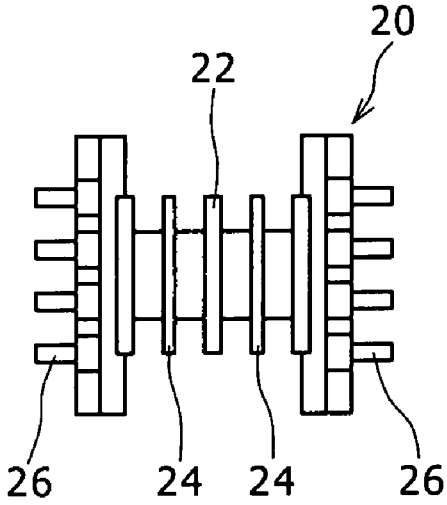
FIGS. 11A and 11B are schematic views showing a structure of a balance coil.
Figure 11B:
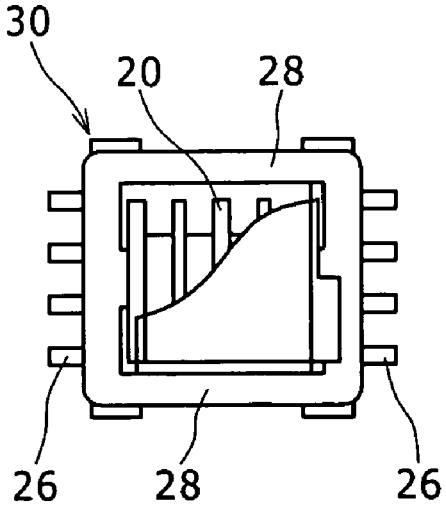

Further, the reason why resonance components of periods shorter than the period of the inverter are superposed is that, as the current flowing through the discharge tube Lp1 decreases to zero, the winding N1 is placed into an open state and is not Q damped, and therefore, resonance occurs in the balance coil Lb and a circuit connected to the balance coil Lb. The inductance component for causing such resonance to occur includes principally a leakage inductance produced on the winding N1 side and an inductance component which the wiring line pattern has, and the capacitance component for causing such resonance to occur principally includes a distribution capacity produced in the balance coil Lb and a capacitance component (floating capacitance) of the wiring line pattern. Here, where the current flowing through the discharge tube Lp1 becomes zero, since the magnitudes of current flowing through the windings N1 and N2 are much different from each other, magnetic fluxes generated in the core (refer to the magnetic core 28 of FIG. 11B) of the balance coil Lb by the winding N1 and magnetic fluxes generated in the core of the balance coil Lb by the winding N2 do not cancel each other. Consequently, the magnetic flux density in the core of the balance coil Lb becomes higher until magnetic saturation occurs with the core and the magnitude of the inductance becomes a very low value when compared with that when the core is not saturated.

In the present embodiment, the shape of the core, the number of turns of the windings N1 and N2, the distribution capacitances generated in the windings N1 and N2, and so forth are set in advance such that the period of resonance where magnetic saturation occurs with the core of the balance coil Lb becomes shorter than the period of ac current supplied from the inverter circuit Ci. It is to be noted that the magnitude of the amplitude of the resonance corresponds to the Q damp amount, and for example, also where the magnitude of current flowing through the discharge tube Lp1 decreases as a result of deterioration of the discharge tube Lp1, the magnitude of resonance frequency components decreases as a result of the Q damp when compared with an alternative case that the current flowing through the discharge tube Lp1 decreases to zero. However, resonance occurs. Therefore, the magnitude of resonance of a resonance frequency component included in the voltage VLbo1 can be used as a barometer which represents a variation of current through the discharge tube Lp1 from a normal value.

Further, the value of the voltage VLbo1 which includes a component of ac current supplied from the inverter circuit Ci where the magnitude of current flowing through the discharge tube Lp1 decreases as a result of deterioration of the discharge tube Lp1 although the current flowing through the discharge tube Lp1, that is, the current In1 flowing through the winding N1, is not zero, is lower than that where the current flowing through the discharge tube Lp1 is zero, but is higher than that in an ordinary state. Consequently, such a feedback action to increase the current to flow through the discharge tube Lp1 acts to cause magnitudes of current equal to each other to flow through the discharge tubes Lp1 and Lp2. Although a variation of the voltage VLbo1 when some failure occurs with operation of the discharge tube Lp1 is described above, when some failure occurs with operation of the discharge tube Lp2, a similar variation occurs with the voltage VLbo2.

Figure 4:
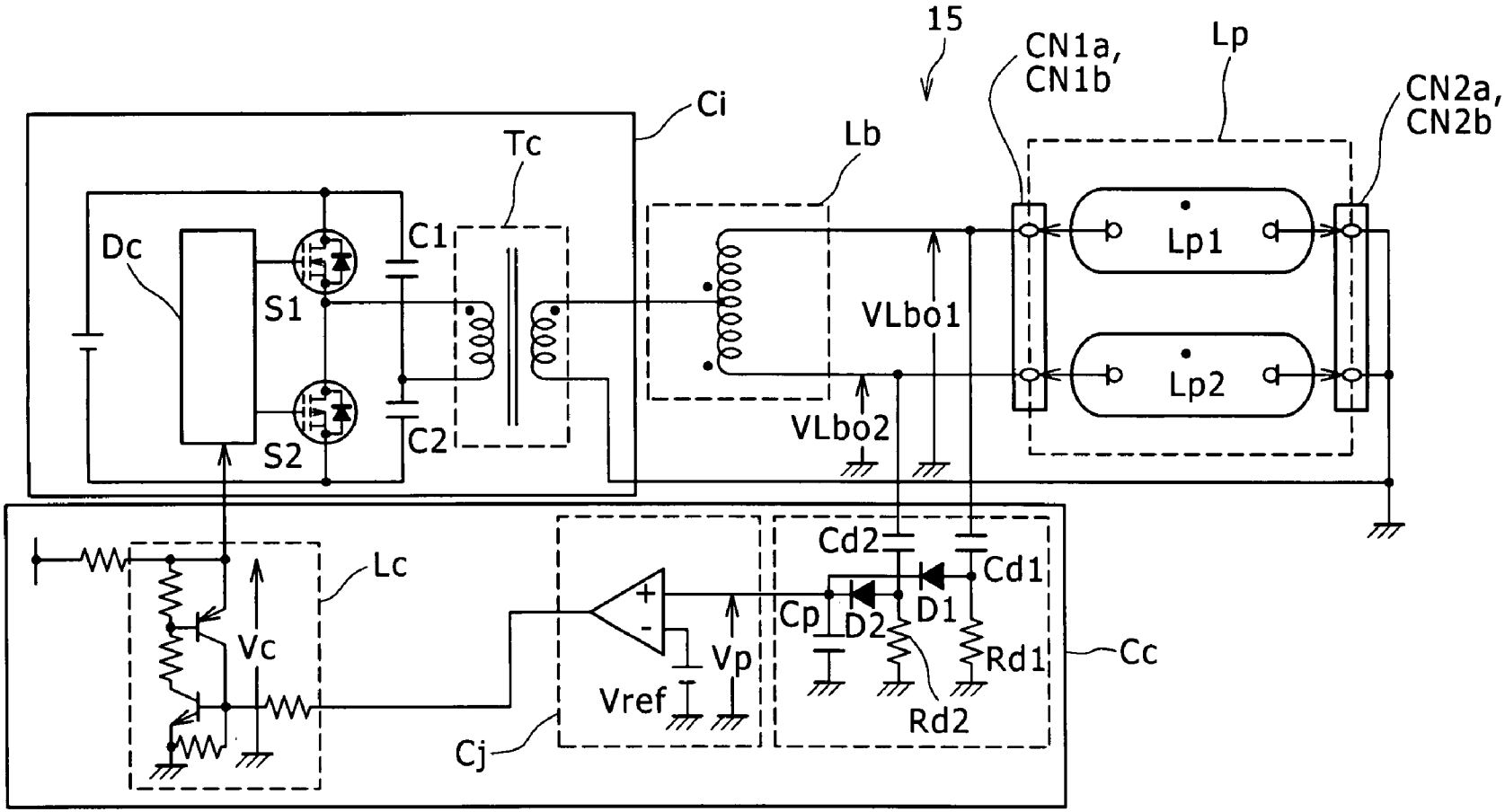
FIG. 4 is a circuit diagram showing a light source apparatus to which an embodiment of the present invention is applied.

FIG. 4 shows a light source apparatus 15 to which the present invention is applied.

Referring to FIG. 4, the light source apparatus 15 shown includes an inverter circuit Ci, a balance coil Lb, and a control section Cc which form a discharge tube lighting apparatus, and a discharge tube Lp1 and another discharge tube Lp2 which form a discharge tube section Lp. The inverter circuit Ci includes a driver circuit Dc, a switch element S1 and another switch element S2, a capacitor C1 and another capacitor C2, and a converter transformer Tc. The inverter circuit Ci, balance coil Lb, and control section Cc are disposed on a circuit board and connected to the discharge tube section Lp by a connector CN1*a* and another connector CN1*b*, and a further connector CN2*a* and a still further connector CN2*b*. The inverter circuit Ci functions as a power section for supplying ac current to a winding input end of the balance coil Lb. The control section Cc functions as a control section for detecting a peak value of a detection voltage according to a voltage at a winding output end of the balance coil Lb and stopping the supply of ac current from the power section when the detected peak value of the voltage is higher than a predetermined value.

The driver circuit Dc generates and supplies ac signals to the switch elements S1 and S2 so as to operate complementarily to each other. A primary winding of the converter transformer Tc is connected between a node of a series connection of the capacitors C1 and C2 and a node of a series connection of the switch elements S1 and S2 to form an inverter circuit of the half bridge type, and ac current from a secondary winding of the converter transformer Tc is supplied to the discharge tubes Lp1 and Lp2 through the balance coil Lb.

The control section Cc includes a differentiating circuit formed from a capacitor Cd1 and a resistor Rd1 and another differentiating circuit formed from a capacitor Cd2 and a resistor Rd2. Output voltages of the differentiating circuits which are detection voltages are supplied to diodes D1 and D2 so that a peak voltage Vp thereof is obtained by the diodes D1 and D2.

The control section Cc further includes a decision circuit Cj formed from a comparator. A reference voltage Vref is inputted to a negative input terminal of the comparator, and the peak voltage Vp is inputted to a positive input terminal of the comparator.

The control section Cc further includes a latch circuit Lc formed from transistors connected in a SCR (Silicon Controlled Rectifier) connection, and an output voltage of the decision circuit Cj is inputted to the latch circuit Lc. A control voltage Vc is supplied from the latch circuit Lc to the driver circuit Dc. When the control voltage Vc has a high level, an ac signal from the driver circuit Dc is supplied to the switch elements S1 and S2 so that ac current is supplied from the inverter circuit Ci. However, when the control voltage Vc has a low level, the ac signal from the driver circuit Dc is not supplied to the switch elements S1 and S2 and the supply of the ac current from the inverter circuit Ci is stopped.

Now, operation of the light source apparatus 15 is described.

Where both of the discharge tubes Lp1 and Lp2 operate normally to emit light, both of the voltages VLbo1 and VLbo2 have a substantially sinusoidal waveform. Therefore, the value of the reference voltage Vref is selected in advance so that the value of the peak voltage Vp obtained by differentiating and peak holding the waveform is lower than the value of the reference voltage Vref. Accordingly, the output voltage of the comparator is substantially 0 V, and the transistors connected in a SCR connection are not rendered conducting. Further, the control voltage Vc which controls the driver circuit Dc maintains a high level. Then, ac current continues to be supplied from the inverter circuit Ci.

Meanwhile, if some anomaly occurs with lighting of one of the discharge tubes Lp1 and Lp2, then the waveform of the voltage VLbo1 or Vlbo2 changes such that it has many high frequency components as seen in FIG. 3. Therefore, the value of the peak voltage Vp obtained by differentiating and peak holding the waveforms becomes a high voltage like that when some anomaly occurs and is higher than the value of the reference voltage Vref. Accordingly, the output voltage of the comparator renders the transistors connected in a SCR connection conducting. After the transistors are rendered conducting once, the conducting state is not canceled until after the power supply is reset. Then, the control voltage Vc which controls the driver circuit Dc maintains a low level. Then, the supply of ac current from the inverter circuit Ci stops, and consequently, otherwise possible damage to the circuit board and to the balance coil can be prevented.

Particularly, where the light source apparatus 15 is configured such that the inverter circuit Ci and the discharge tube Lp1 or the discharge tube Lp2 are connected to each other by connectors, for example, by the connectors CN1*a* and CN1*b* and the connectors CN2*a* and CN2*b*, it provides a considerable effect in that damage to the circuit board and to the balance coil which may be caused by disconnection of any connector can be prevented simply and at a reduced cost when compared with related-art light source apparatus. Further, if the period of resonance is set shorter than the period of the ac current from the inverter circuit Ci, then the detection sensitivity in detection of an anomaly of the light source apparatus 15 can be raised to make the operation of the light source apparatus 15 sure.

In order to reduce the period of resonance, preferably the value of the inductance of the balance coil Lb which contributes to the resonance is minimized, and from this, preferably a conspicuous saturation phenomenon occurs when some imbalance occurs in current of the discharge tubes. Further, a particularly high effect can be anticipated if the period of ac current to be supplied from the inverter circuit Ci is set to a value equal to an integral number of times the resonance frequency.

It is to be noted that, as an example, the capacitors Cd1 and Cd2 had a capacitance of 1 pF (picofarad); the resistors Rd1 and Rd2 had a resistance of 10 kΩ (kilohm); a capacitor Cp had a capacitance of 0.01 μF (microfarad); and the peak voltage Vp in this instance was 2 V in a normal lighting state, 5 V upon starting, and 17 V upon stopping of discharge of one of the discharge tubes Lp1 and Lp2. Further, the reference voltage Vref was set to 11 V.

Figure 5:
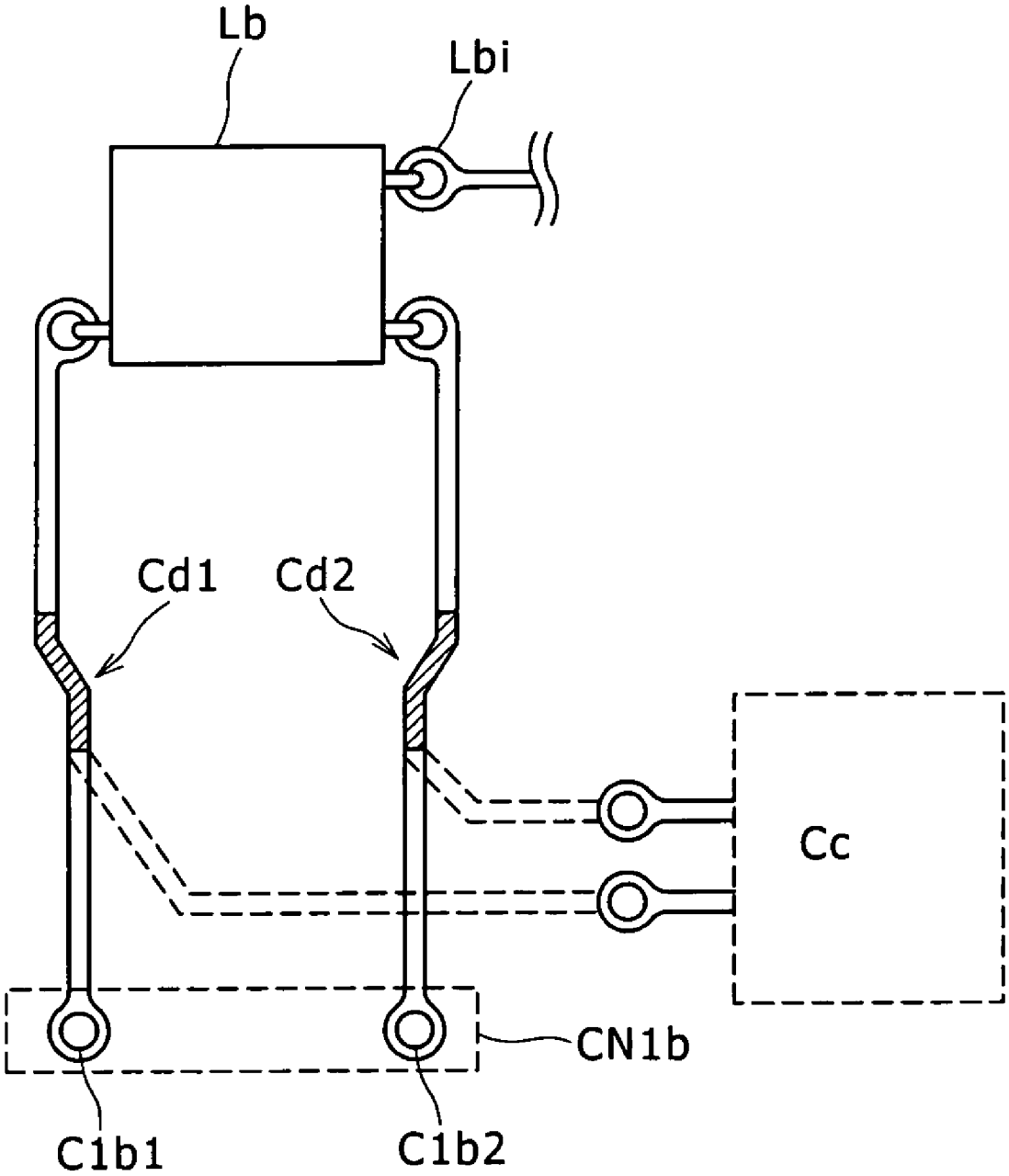
FIG. 5 is a schematic view showing a differentiating capacitor of the light source apparatus of FIG. 4.

In this instance, since a voltage of several kV (kilovolts) is applied to the capacitors Cd1 and Cd2, an expensive capacitor having a high voltage withstanding property is required. Therefore, patterns on the opposite faces of a circuit board were used as electrodes for the capacitors Cd1 and Cd2 as seen in FIG. 5 to implement capacitors of a low capacitance. The cost of the apparatus can be reduced by the countermeasure.

FIG. 5 illustrates in what manner the capacitors Cd1 and Cd2 are formed and schematically shows the capacitors Cd1 and Cd2 as viewed from the surface of the circuit board. Referring to FIG. 5, the balance coil Lb has such a structure of the related-art balance coil as described hereinabove with reference to FIGS. 11A and 11B, and each of the winding input end Lbi and winding output ends Lbo1 and Lbo2 of the balance coil Lb is led out as a terminal, inserted in a through-hole extending through the circuit board from the front surface to the rear surface and connected to a wiring pattern by soldering. In FIG. 5, portions indicated by solid lines extending from portions indicated by slanting lines and denoted by reference characters Cd1 and Cd2 represent wiring line patterns on the front surface of the circuit board, and portions indicated by broken lines extending from the slanting portions denoted by the reference characters Cd1 and Cd2 represent wiring line patterns on the rear surface of the circuit board. Further, the portions indicated by the slanting lines indicate overlapping portions at which wiring line patterns exist on both of the front and rear surfaces of the circuit board, and the capacitors Cd1 and Cd2 are formed from the overlapping portions of the wiring line patterns. In this instance, since the magnitude of the electrostatic capacity is defined by the magnitude of an overlapping area of the wiring line patterns on the front and rear surfaces of the circuit board, the wiring line patterns on the front and rear surfaces are disposed in an overlapping relationship within a range of a predetermined area. The wiring line patterns on the rear surface of the circuit board whose slanting line portions denoted by the reference characters Cd1 and Cd2 form the capacitors Cd1 and Cd2 are connected to the wiring line patterns on the front surface of the circuit board via through-holes, and the front surface wiring line patterns are connected to the control section Cc. Further, the winding output ends Lbo1 and Lbo2 are connected to the contacts C1*b*1 and C1*b*2 of the connector CN1*b* (whose outer profile is indicated by broken lines), respectively, by soldering via through-holes through wiring line patterns on the front surface of the circuit board. It is to be noted that FIG. 5 principally shows a portion of the circuit board at which the capacitors Cd1 and Cd2 are formed and details of the other circuit elements are not shown. In short, the capacitors Cd1 and Cd2 are formed from electrostatic capacity between the wiring line patterns disposed on one face of the circuit board for interconnecting the winding output ends Lbo1 and Lbo2 and the conductive electrodes Dm1 which are ends on one side of the discharge tubes Lp1 and Lp2 and the wiring line patterns disposed on the other surface of the circuit board opposing to the wiring line patterns on the one surface of the circuit board through the circuit board and having a range of a predetermined area.

While, in FIGS. 4 and 5, a detection voltage is detected by a differentiating circuit, alternatively a detection voltage may be generated in response to the voltages VLbo1 and VLbo2 such that supply of ac current from the inverter circuit is stopped when the detection voltage exhibits a peak voltage higher than a predetermined value.

Figure 6:
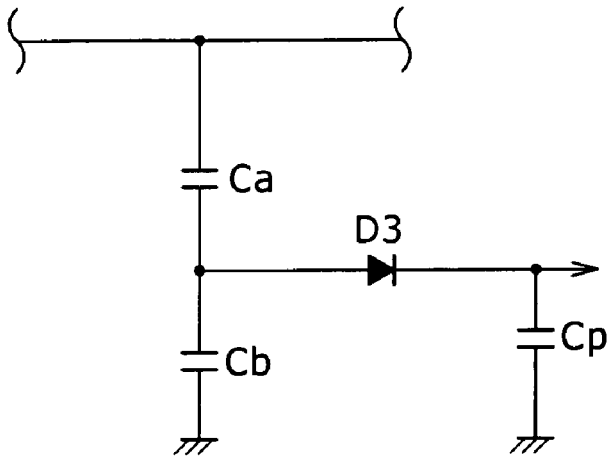
FIG. 6 is a circuit diagram showing a voltage dividing circuit of the light source apparatus of FIG. 4.

FIG. 6 shows a circuit for generating a detection voltage in response to the voltage VLbo1. Referring to FIG. 6, the voltage VLbo1 is divided by a capacitor Ca and another capacitor Cb in accordance with the capacitances of the same, and a peak voltage Vp is detected by means of a diode D3 and a capacitor Cp. With the circuit, if some anomaly occurs with a discharge apparatus and the voltage VLbo1 rises until the peak voltage Vp becomes higher than the predetermined value, then supply of ac current from the inverter circuit can be stopped. Consequently, otherwise possible damage to the circuit board and to the balance coil can be prevented.

If the voltage VLbo1 is divided by the capacitors Ca and Cb in this manner, also the voltage to be applied to the control section can be suppressed low, and therefore, inexpensive circuit parts can be used. Further, if the capacitor Ca is formed from wiring line patterns similarly to that shown in FIG. 5, then the production cost can be further reduced.

Further, even if the capacitors Ca and Cb shown in FIG. 6 are replaced by resistors to divide a voltage, an effect similar to that achieved by voltage division by the capacitors Ca and Cb can be achieved.

Particularly, where the inverter circuit Ci and the discharge tubes Lp1 and Lp2 are connected to each other by means of connectors, more particularly by the connectors CN1*a* and CN1*b* and the connectors CN2*a* and CN2*b*, the light source apparatus 15 exhibits a significant advantage in that damage caused by disconnection of connectors to the circuit board and to the balance coil which forms the discharge lamp lighting apparatus can be prevented simply and at a reduced cost when compared with related-art light source apparatus. Further, the light source apparatus 15 makes it possible to increase the number of turns of the windings N1 and N2 by increasing the saturation magnetic flux amount of the core of the balance coil Lb and increase the magnitude of the voltages Vn1 and Vn2 to raise the detection sensitivity to an anomaly of the light source apparatus 15 thereby to make the operation sure.

Figure 7:
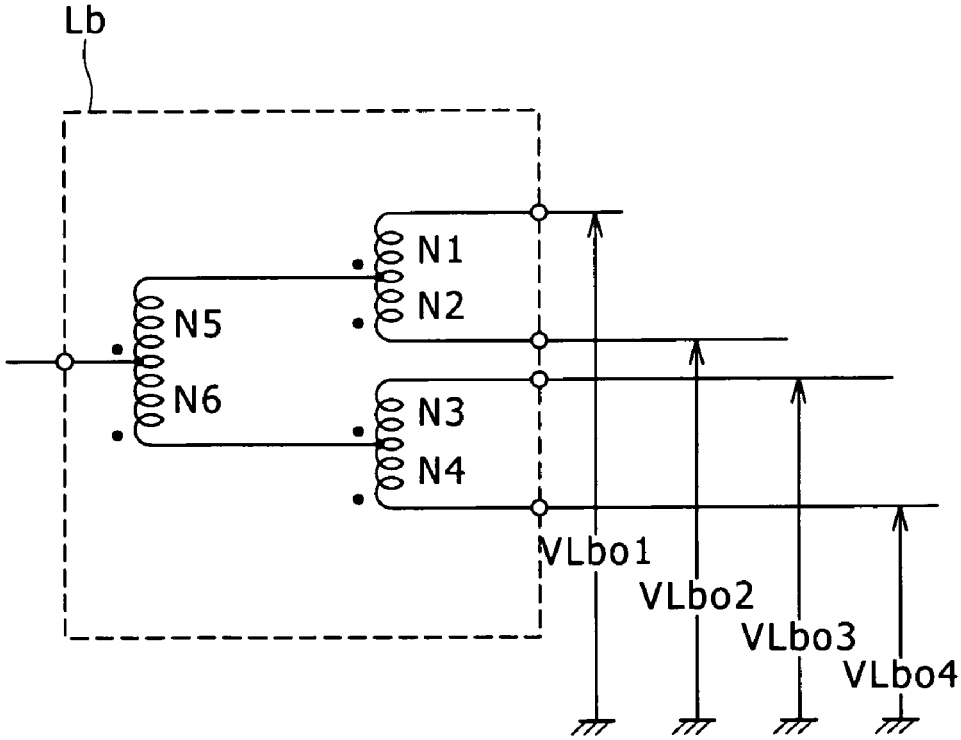
FIGS. 7 and 8 are circuit diagrams showing modification to the voltage dividing circuit shown in FIG. 6.
Figure 8:
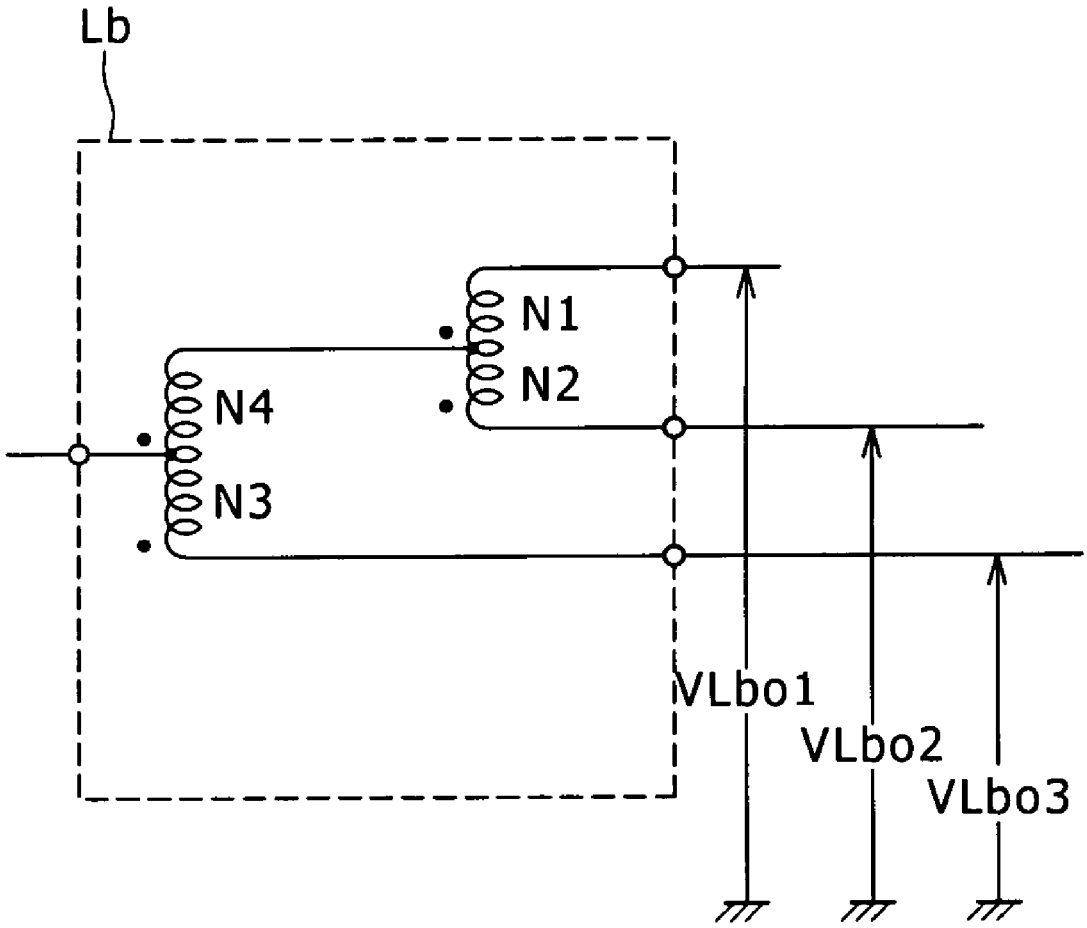

Different forms of the balance coil are shown in FIGS. 7 and 8. Although the balance coil described hereinabove has a one-input two-output configuration, the configuration of the balance coil is not limited to the specific configuration.

The balance coil may be any balance coil which includes a plurality of windings connected to each other such that an input end and a plurality of output ends are provided and a magnetic circuit is formed in such a manner that magnetic fluxes produced by each of the windings cross with all or some of the other windings so that the magnetic fluxes cancel each other to allow electric current of a predetermined value to flow to each of the output ends. Then, by interposing the balance coil between the discharge tubes and the inverter circuit, the magnitude of current to flow through each discharge tube can be controlled to a predetermined value.

FIG. 7 shows a one-input four-output balance coil. Referring to FIG. 7, the balance coil shown is formed from a balance coil whose magnetic circuit is shared by windings N1 and N2, another balance coil whose magnetic circuit is shared by windings N3 and N4, and a further balance coil whose magnetic circuit is shared by windings N5 and N6 and to which the former two balance coils are connected in a tree connection.

Where the balance coil having such a configuration as just described is used, a discharge tube is connected to each of the windings N1, N2, N3, and N4 such that, when a peak value of a voltage obtained by differentiating or dividing each of the voltages Llbo1, Vlbo2, Vlbo3, and Vlbo4 exceeds a predetermined value, supply of ac current from the inverter circuit can be stopped.

By the configuration just described, also where a single inverter circuit is used to cause four discharge tubes to emit light, ac current from the inverter circuit can be made uniform, and supply of power from the inverter circuit can be stopped. Consequently, damage to the circuit board and to the balance coil can be prevented.

FIG. 8 shows a one-input three-output balance coil. Referring to FIG. 8, the balance coil shown is formed from a tree connection of a balance coil whose magnetic circuit is shared by windings N1 and N2 and another balance coil whose magnetic circuit is shared by windings N3 and N4, a node between the windings N1 and N2 being connected to the winding N4.

By the configuration just described, supply of ac current from the inverter circuit can be stopped when a peak value of one of voltages obtained by differentiating or dividing the voltages Llbo1, Vlbo2, and Vlbo3 illustrated in FIG. 8 becomes higher than a predetermined value. It is to be noted that, in this instance, the number of turns of the winding N3 is equal to twice that of the winding N4.

By the configuration just described, also where a single inverter circuit is used to cause three discharge tubes to emit light, ac current from the inverter circuit can be made uniform, and supply of power from the inverter circuit Ci can be stopped. Consequently, damage to the circuit board and to the balance coil can be prevented.

Display Apparatus as an Application of the Discharge Tube Lighting Apparatus

As an application suitable for use with the light source apparatus which uses the discharge tube lighting apparatus described hereinabove, a display apparatus is described. Naturally, however, the field of application of the light source apparatus described above is not limited to display apparatus. For example, the light source apparatus can be applied also to an illumination apparatus as lighting equipment.

Figure 9:
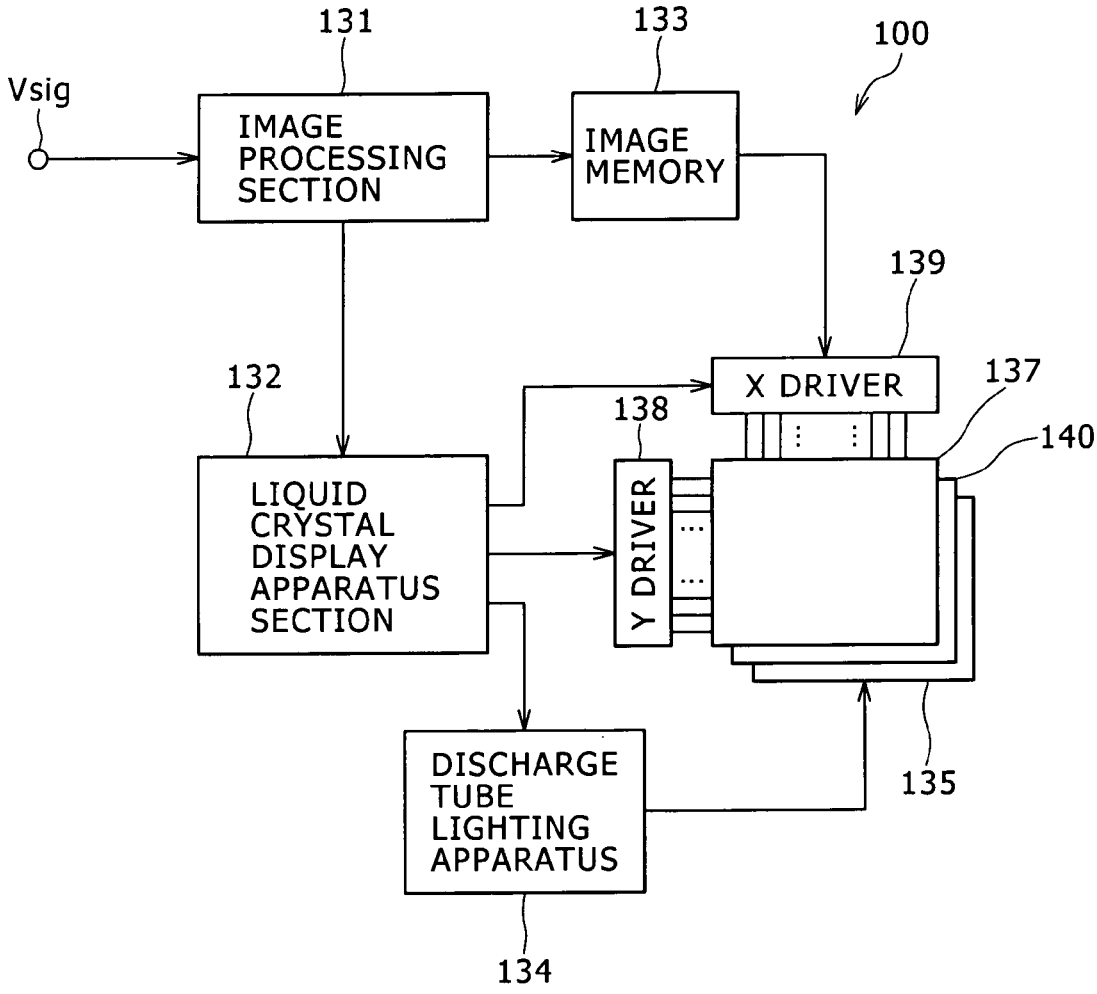
FIG. 9 is a block diagram showing a display apparatus to which an embodiment of the present invention is applied.

FIG. 9 shows a liquid crystal display apparatus 100 which is a form of a display apparatus. The liquid crystal display apparatus 100 includes an image processing section 131, a liquid crystal display apparatus control section 132, an image memory 133, and a discharge tube lighting apparatus 134. The liquid crystal display apparatus 100 further includes a display tube section (backlight assembly section) 135 formed from a plurality of discharge tubes, an optical sheet-diffusion plate 140, a liquid crystal display panel 137, a Y driver 138, and an X driver 139. It is to be noted that, in the liquid crystal display apparatus 100, the display tube section 135 and the display tube section 135 function as a discharge tube section and a discharge tube lighting apparatus of a light source apparatus, respectively.

Operation of the liquid crystal display apparatus 100 described is described simply. When an image signal Vsig is inputted to the image processing section 131, the image processing section 131 divides the image signal Vsig into an image data signal and a synchronizing signal and transfers the image data signal in an X direction (horizontal scanning direction) to the image memory 133 for each one scanning line. Further, the image processing section 131 sends the synchronizing signal to the liquid crystal display apparatus control section 132. Furthermore, the image processing section 131 signals control signals for controlling the Y driver 138 and the X driver 139 and signals a control signal for controlling the discharge tube lighting apparatus 134.

Light emitted from the display tube section 135 is optically processed by the optical sheet-diffusion plate 140 and projected on the rear face of the liquid crystal display panel 137. Then, in the liquid crystal display panel 137, horizontal scanning lines by which an image is displayed are selected line by line by the Y driver 138, and the amount of transmission light is controlled in response to values stored in the image memory 133 by the X driver 139. Therefore, an image according to the image signal Vsig is produced on the surface of the liquid crystal display panel 137. In particular, an image according to the image signal Vsig is displayed on the liquid crystal display panel 137, and the display position of the image is provided by a synchronizing signal included in the image signal Vsig.

Figure 10:
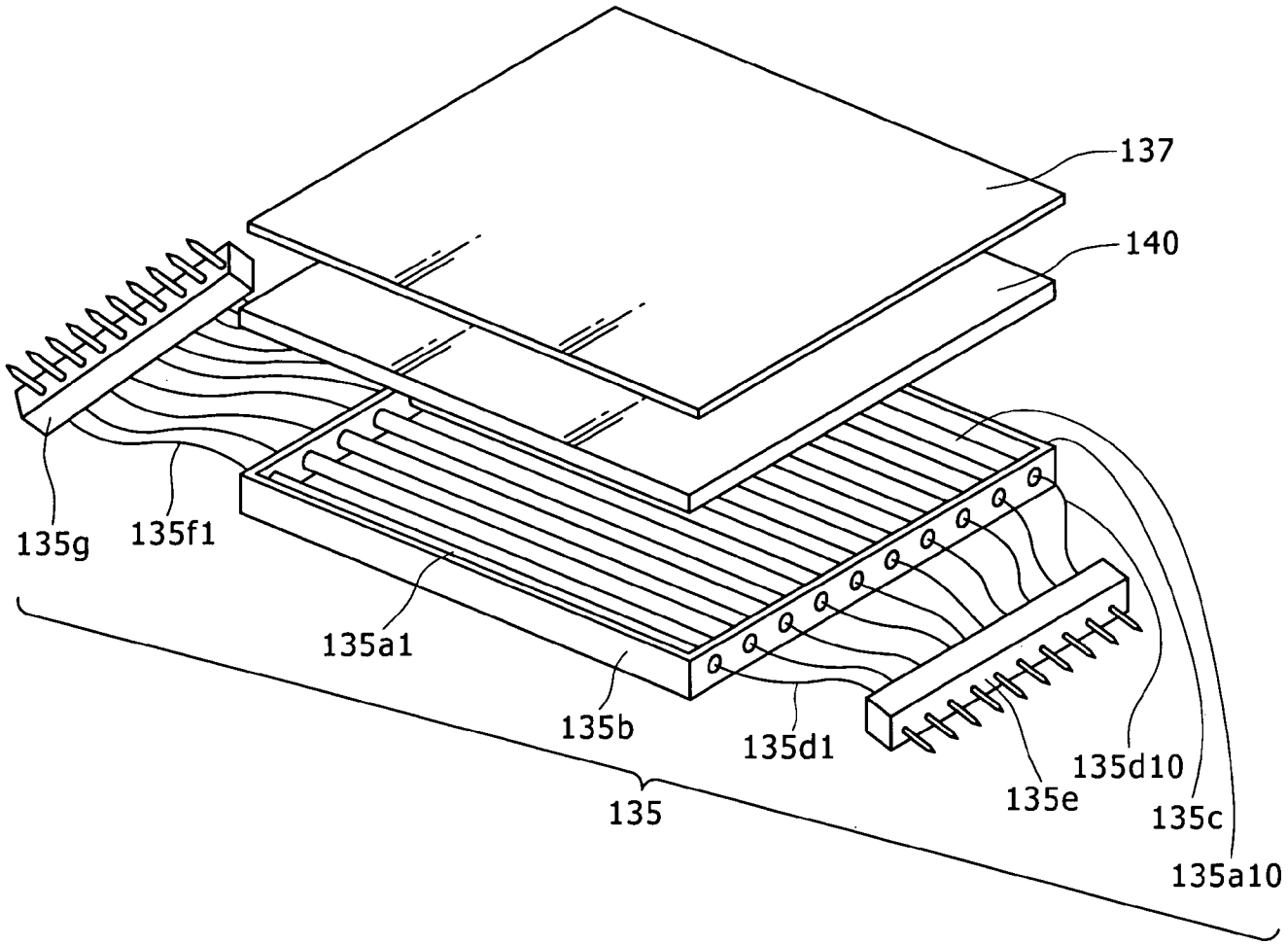
FIG. 10 is a perspective view schematically showing a structure of the display apparatus of FIG. 9 around a discharge tube section.

FIG. 10 schematically shows the display tube section 135. Referring to FIG. 10, the display tube section 135 includes a plurality of discharge tubes 135*a*1 to 135*a*10 (reference characters 135*a*2 to 135*a*9 other than 135*a*1 and 135*a*10 are omitted in FIG. 10). The discharge tubes 135*a*1 to 135*a*10 are arranged in parallel to each other in an equally spaced relationship from each other on a plane by a discharge tube holding frame 135*b*. The conductive electrode Dm1 (refer to FIG. 1) and the conductive electrode Dm2 (refer to FIG. 1) of each of the discharge tubes 135*a*1 to 135*a*10 are connected to connectors 135*e* and 135*g* through wires 135*d*1 to 135*d*10 and wires 135*f*1 to 135*f*10 (wires other than the wires 135*d*1 to 135*d*10 and 135*f*1 are omitted in FIG. 10), respectively.

Each of the connectors 135*e* and 135*g* is coupled to a respective connector not shown disposed in the discharge tube lighting apparatus 134 to form a circuit. Further, the discharge tubes 135*a*1 to 135*a*10 are disposed such that the longitudinal direction thereof substantially coincides with the direction of a horizontal scanning line of the liquid crystal display panel 137, and the plane on which the discharge tubes 135*a*1 to 135*a*10 are disposed extends substantially in parallel to the liquid crystal display panel 137 and the optical sheet-diffusion plate 140.

In short, the display apparatus of the present embodiment includes a liquid crystal display panel 137 for displaying image information, a display tube section 135 disposed on the rear face side of the image display face (face on the upper side in FIG. 10) of the liquid crystal display panel 137, and a discharge tube lighting apparatus 134 for driving the display tube section 135. The discharge tube lighting apparatus 134 has a winding input end Lbi (refer to FIG. 1) of a balance coil Lb and winding output ends of a plurality of balance coils Lb (refer to the winding output ends Lbo1 and Lbo2 of FIG. 1), and includes a balance coil Lb to whose winding output ends a plurality of discharge tubes 135*a*1 to 135*a*10 are connected, an inverter Ci1 serving as a power section for supplying ac power to the winding input end Lbi, and a control section Cc for detecting a peak value of a detection voltage corresponding to all or some of voltages of the winding output ends and stopping, when the peak value of the detection voltage is higher than a predetermined value, supply of ac current from the inverter circuit Ci. By this, the number of discharge tubes to be driven by a single balance coil Lb can be decided suitably in response to the number of inverter circuits Ci connected to the balance coil Lb and the magnitude of the power to be supplied from the inverter circuit Ci.

While preferred embodiments of the present invention have been described using specific terms, such description is for illustrative purposes only, and it is to be understood that changes and variations may be made without departing from the spirit or scope of the following claims.

The invention claimed is:

1. A discharge tube lighting apparatus for driving a plurality of discharge tubes, comprising:

a balance coil having a winding input end and a plurality of winding output ends to which the discharge tubes are connected individually;

a power section for supplying ac current to the winding input end of the balance coil;

a detection section including differentiating circuits at each of said plurality of winding output ends, said differentiating circuits being operable to detect a peak voltage value at each of said winding output ends through time differentiation; and a control section for stopping the supply of the ac current from the power section when any of the peak voltage values detected by said differentiating circuits is higher than a predetermined value.

2. The discharge tube lighting apparatus according to claim 1, wherein the balance coil is set such that periods of resonance which occur when magnetic fluxes are generated in the balance coil are shorter than repetition periods of the ac current supplied from the power section.

3. The discharge tube lighting apparatus according to claim 2, wherein each of the differential circuits is formed from a capacitor and a resistor, and the capacitor is formed from an electrostatic capacity between a first wiring line pattern disposed on one face of a circuit board on which each winding output end and a one-side end of the corresponding discharge tube are connected to each other and a second wiring line pattern disposed on the other face of the circuit board and opposed to the first wiring line pattern within a range of a predetermined area with the circuit board interposed therebetween.

4. The discharge tube lighting apparatus according to claim 1, wherein said control section includes a latch circuit formed from transistors connected in a silicon-controlled-rectifier configuration, and wherein when any of the peak voltage values detected by said differentiating circuits is greater than said predetermined value, said transistors connected in a silicon-controlled-rectifier configuration conduct and continue to conduct until a power supply of the discharge tube lighting apparatus is switched off.

5. A light source apparatus, comprising:

a balance coil having a winding input end and a plurality of winding output ends;

a discharge tube section including a plurality of discharge tubes individually connected to the winding output ends of the balance coil;

a power section for supplying ac current to the winding input end of the balance coil;

a detection section including differentiating circuits at each of said plurality of winding output ends, said differentiating circuits being operable to detect a peak voltage value at each of said winding output ends through time-differentiation ; and a control section for stopping the supply of the ac current from said power section when any of the peak voltage values detected by said differentiating circuits is higher than a predetermined value.

6. The light source apparatus according to claim 5, wherein the balance coil is set such that periods of resonance which occurs when magnetic fluxes are generated in the balance coil are shorter than a repetition periods of the ac current supplied from the power section.

7. A display apparatus, comprising:

a liquid crystal display panel having an image display face for displaying image information;

a discharge tube section disposed on a rear face of the liquid crystal display panel opposite the image display face; and a discharge tube lighting apparatus for driving the discharge tube section;

the discharge tube lighting apparatus including a balance coil having a winding input end and a plurality of winding output ends to which the discharge tubes are connected individually, a power section for supplying ac current to the winding input end of the balance coil, a detection section including differentiating circuits at each of said plurality of winding output ends, said differentiating circuits being operable to detect a peak voltage value at each of said winding output ends through time-differentiation; and a control section for stopping the supply of the ac current from the power section when any of the peak voltage values detected by said differentiating circuits is higher than a predetermined value.

8. The display apparatus according to claim 7, wherein said control section includes a latch circuit formed from transistors connected in a silicon-controlled-rectifier configuration, and wherein when any of the peak voltage values detected by said differentiating circuits is greater than said predetermined value, said transistors connected in a silicon-controlled-rectifier configuration conduct and continue to conduct until a power supply of the discharge tube lighting apparatus is switched off.

9. The display apparatus according to claim 7, wherein the balance coil is set such that periods of resonance which occur when magnetic fluxes are generated in the balance coil are shorter than repetition periods of the ac current supplied from the power section.

* * * * *

UNITED STATES PATENT AND TRADEMARK OFFICE

CERTIFICATE OF CORRECTION

PATENT NO. : 7,294,973 B2
APPLICATION NO. : 11/430337
DATED : November 13, 2007
INVENTOR(S) : Masanobu Takahama and Yoshiki Oyama It is certified that error appears in the above-identified patent and that said Letters Patent is hereby corrected as shown below:

Column 14, line 32, “time differentiation” should read --time-differentiation--;
Column 15, line 14, the word “occurs” should read --occur--;
Column 15, line 15, delete the word “a” after the word “than”.

Signed and Sealed this

Fourteenth Day of October, 2008

JON W. DUDAS
*Director of the United States Patent and Trademark Office*